US005088375A

United States Patent [19]

Saijo

[11] Patent Number: 5,088,375

[45] Date of Patent: Feb. 18, 1992

[54] TREMOLO DEVICE FOR STRING MUSICAL INSTRUMENT

[75] Inventor: Yatsuse Saijo, Tokyo, Japan

[73] Assignee: Fernandes Co., Ltd., Japan

[21] Appl. No.: 594,760

[22] Filed: Oct. 9, 1990

[30] Foreign Application Priority Data

Oct. 9, 1989 [JP] Japan ..... 1-262182

[51] Int. Cl.[5] ..... G10D 3/00

[52] U.S. Cl. ..... 84/313

[58] Field of Search ..... 84/290, 298, 299, 307, 84/312 R, 312 P, 313

[56] References Cited

U.S. PATENT DOCUMENTS 2,741,146 4/1956 Fender ..... 84/313
4,475,432 10/1984 Stroh ..... 84/313 X
4,555,970 12/1985 Rose ..... 84/313

*Primary Examiner*—L. T. Hix
*Assistant Examiner*—Howard B. Blankenship
*Attorney, Agent, or Firm*—Finnegan, Henderson, Farabow, Garrett & Dunner

[57] ABSTRACT

A tremolo device for an electric guitar comprises a movable block, to which the strings are anchored, which is swingable about a swing axis perpendicular to the strings. The block has counter balance tensile springs for providing a tension on all of the strings, whereby an equilibrium is established between the tension imposed by the counter balance tensile springs and the tension imposed on all of the strings, whereby the block is kept at a neutral position. A tremolo handle is rotatably attached to the block, and is rotatable between an operative position at which the handle can be manually operated by a player, to produce a movement of the block about the swing axis and change the tension imposed on all of the strings, and an inoperative position at which the handle cannot be accidentally touched by the player. The device comprises a lock mechanism for locking the block at the neutral position at a middle location thereof, and the lock mechanism is actuated by rotating the handle from the operative position to the inoperative position.

9 Claims, 5 Drawing Sheets

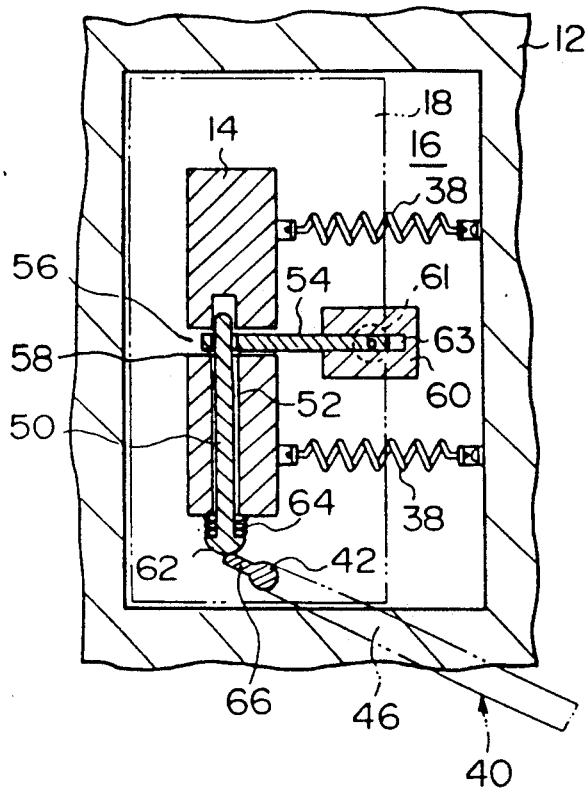
Fig. 3
Fig. 4
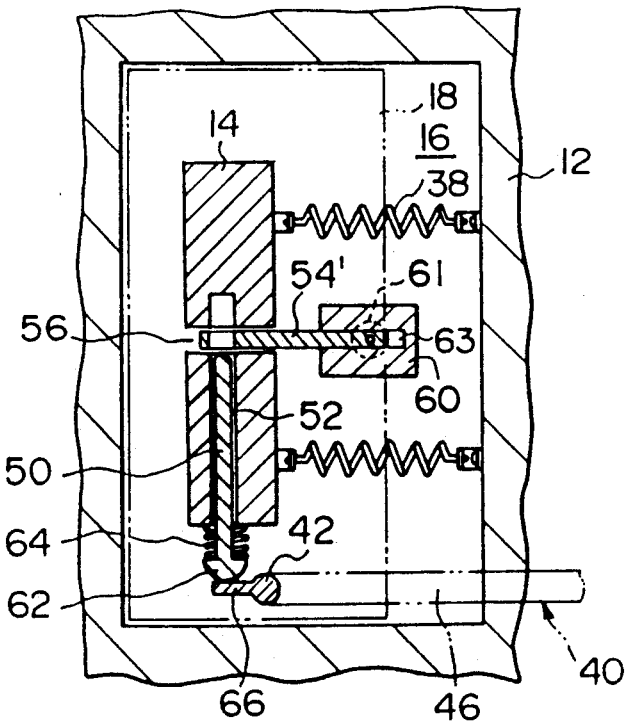

TREMOLO DEVICE FOR STRING MUSICAL INSTRUMENT

BACKGROUND OF THE INVENTION

1) Field of the Invention

The present invention relates to a tremolo device for string musical instruments, in particular a guitar, which device is actuated to change the tension on all strings of the instrument to thereby produce a tremolo tone effect during a musical performance, and more particularly, it relates to a tremolo device that can be locked to prevent an undesirable changing of the string tension when the device is not used.

2) Description of the Related Art

As disclosed in U.S. Pat. Nos. 2,741,146 and U.S. Pat. No. 4,555,970, a tremolo device for a guitar, especially, an electric guitar, is well known and is used to continuously vary or cause a vibration of musical tones within a given range, as required by the player. As mentioned above, this tremolo tone effect is obtained by simultanously changing the tension on all strings of the guitar. Various types of tremolo device are known, for example, a synchronized type developed by the Fender Company; a "Bigsby" type developed by the Gibson Company; and a "Vibramute" type developed by the Mosrite Company, and these tremolo devices have basically similar constructions.

As shown in the afore-mentioned U.S. Patents, the tremolo device comprises a movable block member disposed in an opening formed in a soundboard or body of the guitar. The movable block member has a plate-like member fixed to a top thereof, and a bridge for anchoring the guitar strings is fixed to the plate-like member. The plate-like member is abutted against fulcrum elements fixed on a front surface of the guitar body, so that the movable block member is swingable about a swing axis perpendicular to the guitar strings. The movable block member is provided with counter balance tensile springs for providing a tension on the guitar strings, so that an equilibrium is established between the tension of the counter balance tensile springs and the tension on all of the guitar strings, whereby the movable block member is kept at a neutral position.

A tremolo handle is rotatably attached to the movable block member, and is rotatable between an operative position at which the tremolo handle can be manually operated by a player and an inoperative position at which the tremolo handle cannot be accidentally touched by the player. When the tremolo device is to be used, the tremolo handle is moved to the operative position, and by manually moving the tremolo handle toward and away from the front surface of the guitar body, the movable block member is swung about the swing axis perpendicular to the strings, whereby the tension on all of the strings is changed to thereby produce a tremolo tone effect during a musical performance. Namely, when the tremolo handle is moved toward the front surface of the guitar body, the strings are loosened, whereby the pitches thereof are lowered, and when the tremolo handle is moved away from the front surface of the guitar body, the strings are further tightened, whereby the pitches thereof are raised.

When the tremolo device is not to be used, the tremolo handle is moved to the inoperative position because, if the tremolo handle is left at the operative position, the player's hand may come into contact with the tremolo handle, and thus the pitches of the strings will be undesirably changed. As mentioned above, when the tremolo handle is at the inoperative position, it cannot be accidentally touched by the player.

Nevertheless, when the guitar is played in a special style, the pitches of the strings may be changed. In particular, for example, in a mute style, the player's hand rests on the bridge, and thus the movable block member may be pushed down and the pitches of the strings thereby raised.

U.S. Pat. No. 4,475,432 and Japanese Unexamined Patent Publication (KOKAI) No. 62-90695 disclose a tremolo device provided with a lock mechanism for locking the movable block member at the neutral position when the tremolo handle is moved from the operative position to the inoperative position. Specifically, the lock mechanism includes a collar member fixed to a root portion of the tremolo handle and having a latch element radially projected therefrom, and a catch member fixed to the front surface of the guitar body and having a slot for receiving the latch element of the collar member. When the tremolo handle is at the operative position, the latch element is disengaged from the slot of the catch member and the tremolo device can be actuated, and when the tremolo handle is rotated from the operative position to the inoperative position, the latch element of the collar member is engaged with the slot of the catch member and the movable block member is locked at the neutral position. Nevertheless, this lock mechanism fails to stably lock the movable block member at the neutral position, because the movable block member is merely locked at the side thereof to which the tremolo handle is attached. Namely, since the other side of the movable block member is not locked or constrained, the movable block member can be moved about the locked side thereof when the player's hand rests on the bridge, and thus the pitches of the strings may be raised while the player is performing, for example, in the mute style.

SUMMARY OF THE INVENTION

Therefore, an object of the present invention is to provide a tremolo device provided with a lock mechanism by which the movable block member can be stably locked at the neutral position when the tremolo handle is moved from the operative position to the inoperative position.

In accordance with the present invention, there is provided a tremolo device for string musical instruments, the device comprising a movable block member to which strings of a musical instrument are anchored, the movable block member being swingable about a swing axis perpendicular to the strings, and provided with a counter balance tensile spring so that an equilibrium is established between the tension of the counter balance spring and the total tension of the strings, whereby the movable block member is kept at a neutral position. The tremolo device also comprises a tremolo handle rotatably attached to the movable block member and rotatable between an operative position at which the tremolo handle can be manually operated by a player to produce a movement of the movable block member about the swing axis thereof to change the tension on all of the strings, and an inoperative position at which the tremolo handle can not be accidentally touched by the player. The tremolo device further comprises a lock mechanism for locking the movable block member at the neutral position at a middle location thereof, in such a manner that the movable block member is prevented from being moved in at least a down direction in which the tension of the strings is increased, and the lock mechanism is actuated by rotating the tremolo handle from the operative position to the inoperative position.

According to a preferred embodiment of the present invention, the lock mechanism includes a lock pin slidably received in a guide passage formed in the movable block member, so that the lock pin is movable between a non-lock position and a lock position. The lock mechanism also includes a cam element formed as a part of the tremolo handle, and a spring means associated with the lock pin for resiliently biasing the lock pin against the cam element. The lock pin is moved from the non-lock position to the lock position by the cam element, when the tremolo handle is moved from the operative position to the inoperative position. The lock mechanism further includes a catch member disposed at a middle location with respect to the movable block member, and the lock pin is caught by the catch member to lock the movable block member at the neutral position, to thereby prevent a movement of the movable block member about the swing axis thereof when the lock pin is at the lock position.

According to another preferred embodiment of the present invention, the lock mechanism includes a lock pin slidably received in a guide passage formed in the movable block member, so that the lock pin is movable between a non-lock position and a lock position.

The lock mechanism also includes a cam element formed as a part of the tremolo handle, and a spring means associated with the lock pin for resiliently biasing the lock pin against the cam element. The lock pin is moved from the non-lock position to the lock position by the cam element when the tremolo handle is moved from the operative position to the inoperative position. The lock mechanism further comprises a stop member disposed at a middle location with respect to the movable block member, and the lock pin is abutted against the stop member to thereby prevent the movement of the movable block member in the down direction when the lock pin is at the lock position.

According to yet another preferred embodiment of the present invention, the lock mechanism includes a first pin slidably received in a first guide passage formed in the movable block member, and a second pin slidably received in a second guide passage formed in the movable block member, so that the second pin is movable between a non-lock position and a lock position.

The lock mechanism also includes a lever for operatively connecting the first and second pins, so that a movement of the first pin is magnified and transmitted to the second pin, and the second pin is movable between a non-lock position and a lock position.

The lock mechanism further includes a cam element formed as a part of the tremolo handle, and a spring means associated with at least one of the first and second pins for resiliently biasing the first pin against the cam element. The second pin is moved from the non-lock position to the lock position by the cam element when the tremolo handle is moved from the operative position to the inoperative position. The lock mechanism further includes a catch member disposed at a middle location with respect to the movable block member, and the second pin is caught by the catch member to lock the movable block member at the neutral position, to prevent a movement of the movable block member about the swing axis thereof when the second pin is at the lock position. Preferably, the tremolo handle is detachably attached to the movable block member. In this case, the lock mechanism further includes a plunger element movable between a first position at which the plunger element is engaged with the first pin to move the second pin from the non-lock position to the lock position, and a second position at which the plunger element is disengaged from the first pin, and a spring means for resiliently biasing the plunger element from the second position to the first position. The plunger element is forcibly moved from the first position to the second position by the attachment of the tremolo handle to the movable block member.

According to yet another preferred embodiment of the present invention, the lock mechanism includes a first pin slidably received in a first guide passage formed in the movable block member, and a second pin slidably received in a second guide passage formed in the movable block member, so that the second pin is movable between a non-lock position and a lock position.

The lock mechanism also includes a lever for operatively connecting the first and second pins so that a movement of the first pin is magnified and transmitted to the second pin, and the second pin is movable between a non-lock position and a lock position.

The lock mechanism further includes a cam element formed as a part of the tremolo handle, and a spring means associated with at least one of the first and second pins for resiliently biasing the first pin against the cam element. The second pin is moved from the non-lock position to the lock position by the cam element when the tremolo handle is moved from the operative position to the inoperative position. The lock mechanism further includes a stop member disposed at a middle location with respect to the movable block member, and the second pin is abutted against the stop member to lock the movable block member at the neutral position and prevent a movement of the movable block member in the down direction when the second pin is at the lock position. Preferably, the tremolo handle is detachably attached to the movable block member. In this case, the lock mechanism further includes a plunger element movable between a first position at which the plunger element is engaged with the first pin to move the second pin from the non-lock position to the lock position, and a second position at which the plunger element is disengaged from the first pin, and a spring means for resiliently biasing the plunger element from the second position to the first position, the plunger element being forcibly moved from the first position to the second position by the attachment of the tremolo handle to the movable block member.

BRIEF DESCRIPTION OF THE DRAWINGS

The other objects and advantages of the present invention will be better understood from the following description, with reference to the accompanying drawings, in which:

FIG. 3 is a sectional view similar to FIG. 2, but showing the tremolo handle at an inoperative position;

FIG. 4 is a sectional view corresponding to FIG. 2, showing a modification of the embodiment of FIGS. 1 to 3;

DESCRIPTION OF THE PREFERRED EMBODIMENTS

Figure 1:
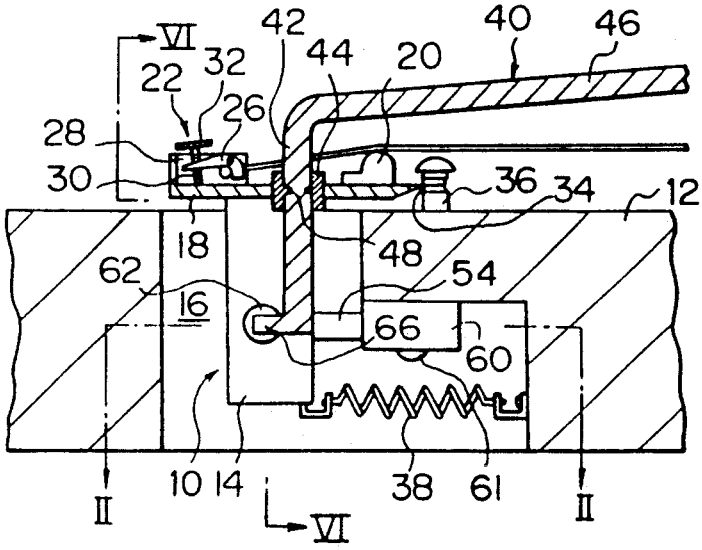
FIG. 1 is a sectional view taken along a line I—I of FIG. 2, showing an embodiment of a tremolo device according to the present invention.
Figure 2:
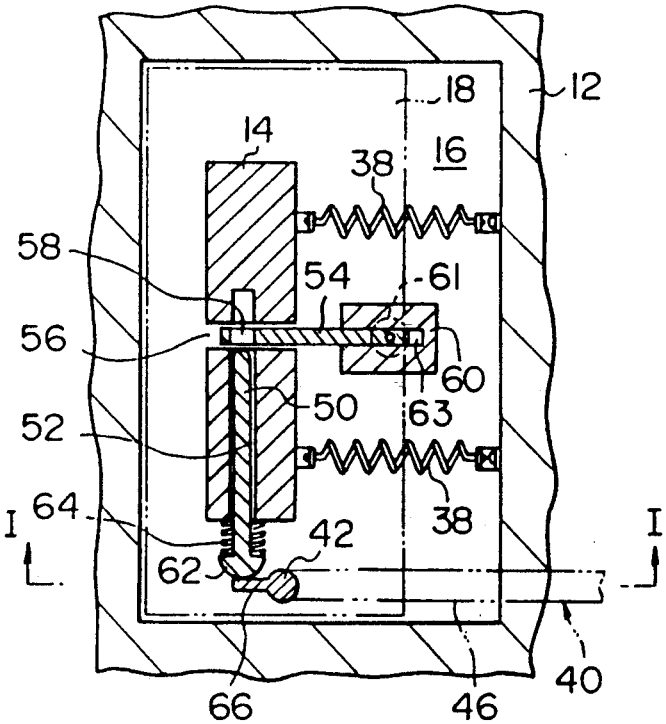
FIG. 2 is a sectional view taken along a line II—II of FIG. 1, showing a tremolo handle at an operative position thereof.

As shown in FIGS. 1, 2, and 3, a tremolo device according to the present invention, which is generally indicated by reference numeral 10, is incorporated in a soundboard or body 12 of an electic guitar. The tremolo device 10 comprises a movable block member 14 disposed in an opening 16 formed in the guitar body 12, a plate-like member 18 fixed to a top of the movable block member 14, and a bridge 20 fixed to the plate-like member 18. The plate-like member 18 has six adjusters 22 (only one is shown in FIG. 1) fixed thereon, to each of which a guitar string 24 is anchored, and the six guitar strings 24 rest on the bridge 20. The adjuster 22 includes a bell crank element 26 pivoted on an upright piece 28 extended from the plate-like member 18, and an adjustment screw 30 threadedly engaged with the bell crank element 26 and having an upper knurled head 32. By manually turning the upper knurled head 32 of the adjustment screw 30, the bell crank element 26 is swung to enable a fine tuning of each of the guitar strings 24.

The plate-like member 18 has a knife edge 34 formed along a side thereof, which is abutted against a pair of notched fulcrum elements 36 fixed on a front surface of the guitar body 12 and disposed adjacent to the ends of the knife edge 34, so that the movable block member 14 is swingable about a swing axis perpendicular to the guitar strings 24. The movable block member 14 is provided with counter balance tensile springs 38 for providing a tension on all of the guitar strings 24. As shown in FIG. 1, the counter balance tensile springs 38 are disposed in the opening 16 of the guitar body 12 and act on a bottom of the movable block member 14 and a wall portion defining the opening 16, whereby an equilibrium is established between the tension of the counter balance tensile springs 38 and the tension on all of the guitar strings 24, and thus the movable block member 14 is kept at a neutral position.

The tremolo device 10 also comprises a tremolo handle 40 rotatably supported by the plate-like member 18. In particular, the tremolo handle 40 has a root portion 42 rotatably received in a collar member 44 supported by the plate-like member 18, and a handle portion 46 radially extended from the root portion 42 in such a manner that it is inclined with respect to the front surface of the guitar body 12. The collar member 44, which may be formed of a suitable resin such as Derlin, available from Du pont, has a circular ridge 48 projected from an inner cylindrical wall of the collar member 44 and received in a circular groove formed around the root portion 42 of the tremolo handle 40, and thus the root portion 42 can be rotated in the collar member 44 but is axially immovable therein. Accordingly, the tremolo handle 40 is rotatable between an operative position shown in FIG. 2 and an inoperative position shown in FIG. 3.

The tremolo device 10 is actuated by manually moving the tremolo handle 40 positioned at the operative position shown in FIG. 2. In particular, by manually moving the handle portion 46 of the tremolo handle 40 toward and away from the front surface of the guitar body 12, the movable block member 14 is swung about the notched fulcrum elements 36, whereby the tension on all of the guitar strings 24 is changed to produce a tremolo tone effect. Namely, when the handle portion 46 of the tremolo handle 40 is moved toward the front surface of the guitar body 12, the guitar strings are loosened whereby the pitches thereof are lowered, and when the handle portion 46 of the tremolo handle 40 is moved away from the front surface of the guitar body 12, the guitar strings are tightened whereby the pitches thereof are raised.

The tremolo device 10 further comprises a lock mechanism for locking the movable block member 14 at the neutral position. Note, this lock mechanism is actuated by rotating the tremolo handle 40 from the operative position of FIG. 2 to the inoperative position of FIG. 3, as stated in detail hereinafter.

The lock mechanism includes a lock pin 50 received in a guide passage 52 formed in the movable block member 14 and extended along an axis perpendicular to the guitar strings, a catch member 54 partially received in a slot 56 formed in the movable block member 14 at a middle location thereof, preferably, a central location thereof, to thereby perpendicularly intersect the guide passage 52. As apparent from FIGS. 2 and 3, the catch member 54 has a through hole 58 formed at one end portion thereof received in the slot 56. The other end portion of the catch member 54 is slidably received in a groove formed in a block element 60 securely fixed to a wall portion defining the opening 16, and can be secured to the block element 60 by a set screw 61, which is screwed in the other end portion of the catch member 54 through an elongated slot 63 formed in the block element 60. Note, while the guitar strings are tuned, the set screw 61 is loosened, and after the tuning of the guitars strings is completed, the set screw 61 is tightened so that the catch member 54 is immovably secured to the block element 60. The lock pin 50 has a head 62 formed at an outer end thereof, and is provided with a compressed coil spring 64 which is contrained between the head 62 and a side face of the movable block member 14. The compressed coil spring 64 exerts a resilient force upon the lock pin 50 so that the head 62 of the lock pin 50 is resiliently abutted against a tongue element or cam element 66 projected from a lower end of the root portion 42 of the tremolo handle 40. When the tremolo handle 40 is at the operative position of FIG. 2, the lock pin 50 is maintained at a non-lock position as shown in FIG. 2, at which the lock pin 50 is disengaged from the through hole 58 of the catch member 54. When the tremolo handle 40 is rotated from the operative position of FIG. 2 to the inoperative position of FIG. 3, the lock pin 50 is moved by the tongue element 66 from the non-locked position of FIG. 2 to a lock position as shown in FIG. 3, at which the lock pin 50 is caught by the through hole 58 of the catch member 54, whereby the tremolo device 10, and thus the movable block member 14, is locked at the neutral position so that the tremolo device 10 cannot be actuated.

With the arrangement as mentioned above, since the movable block member 14 is locked at the middle location thereof, it cannot be pushed down into the opening 16 when a player's hand is resting on the bridge 20, for example, when playing in the mute style.

Namely, when the player's hand is resting on the bridge 20, the pitches of the guitar strings cannot be changed accidentally. Note, as mentioned hereinbefore, conventionally the movable block member can be pressed slightly downward when the players's hand rests on the bridge, because the movable block member is locked at only one side thereof. The emboidment of FIGS. 1 to 3 is further characterized in that the movable block member 14 is locked, to prevent an upward movement thereof by which the guitar strings are loosened, because the lock pin 50 is caught by the through hole 58 of the catch member 54. Namely, in this embodiment, a movement of the movable block member 14 about the swing axis thereof is prevented.

FIG. 4 shows a modification of the embodiment of FIGS. 1 to 3. In this modified embodiment, a stop member 54' is substituted for the catch member 54, and when the tremolo handle 40 is rotated from the operative position to the inoperative position, the lock pin 50 is abutted against an end of the stop member 54'. With this arrangment, when the handle portion 46 of the tremolo handle 40 is moved toward the front surface of the guitar body 46, the movable block member 14 can be raised, but cannot be pressed down into the opening 16 when the player's hand rests on the bridge 20, due to the abutment of the lock pin 50 against the stop member 54'. Of course, this modified embodiment is also characterized in that the movable block member 14 is locked at the middle location thereof.

Figure 5:
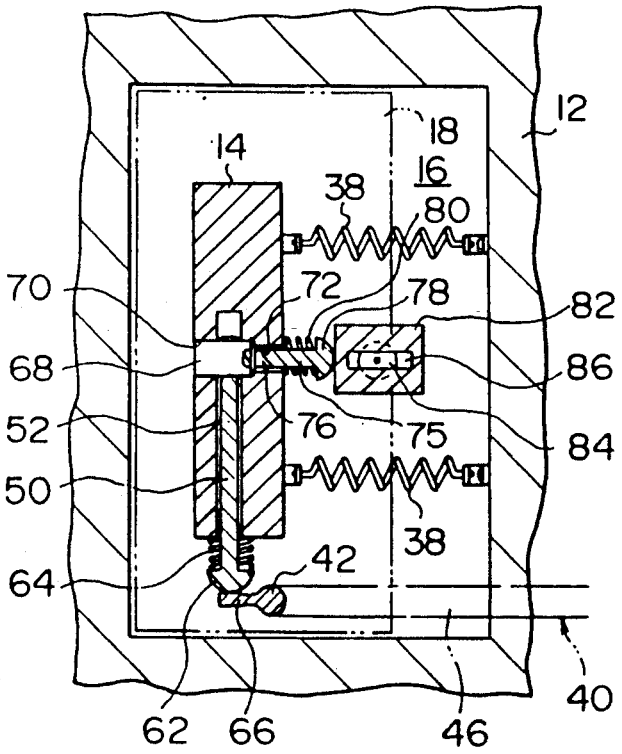
FIG. 5 is a sectional view corresponding to FIG. 2, showing another embodiment of a tremolo device according to the present invention.

FIG. 5 shows another embodiment of a tremolo device according to the present invention. In FIG. 5, elements similar to those shown in FIGS. 1 to 3 are indicated by the same reference numerals. In this embodiment, a through passage 68 is formed in the movable block member 14 at a middle location thereof, preferably, at a central location thereof, to perpendicularly intersect the guide passage 52. As shown in FIG. 5, the through passage 68 includes an enlarged portion 70 and a reduced portion 72, with a circular shoulder 74 (See FIG. 9) formed therebetween. A stop member 75 is slidably inserted in the reduced portion 72 of the through passage 68, and has a pin element 76 extended through an inner end thereof and engaged with the circular shoulder 74, so that it cannot slip out of the reduced portion 72 of the through passage 68. The stop member 75 has a head 78 formed at an outer end thereof, and is provided with a coil spring 80 which is constrained between the head 78 and a wall portion of the movable block member 14. The head 78 of the stop member 75 is abutted against a block element 82 fixed by a set screw 84 to a wall portion defining the opening 16. As apparent from FIG. 5, the set screw 84 is screwed in the guitar body 12 through an elongated slot 86 formed in the block element 82, whereby a fixed position of the block element 82 is adjustable. Namely, while the guitar strings are being tuned, the set screw 84 is loosened and the block member 82 becomes movable, and when the tuning of the guitars strings is completed, the block element 82 is abutted against the head 78 of the stop member 75 and is then immovably fixed thereat by tightening the set screw 84.

The tremolo device shown in FIG. 5 can be locked in substantially the same manner as in FIG. 4 but has an advantage of holding the movable block member 14 at the neutral position even if one of the quitar strings 24 is broken while the tremolo handle 40 is at the operative position. Namely, although one of the guitar strings 24 is broken, the equilibrium between the tension of the counter balance tensile springs 38 and the tension on all of the guitar strings can be substantially maintained by the coil spring 80.

Figure 6:
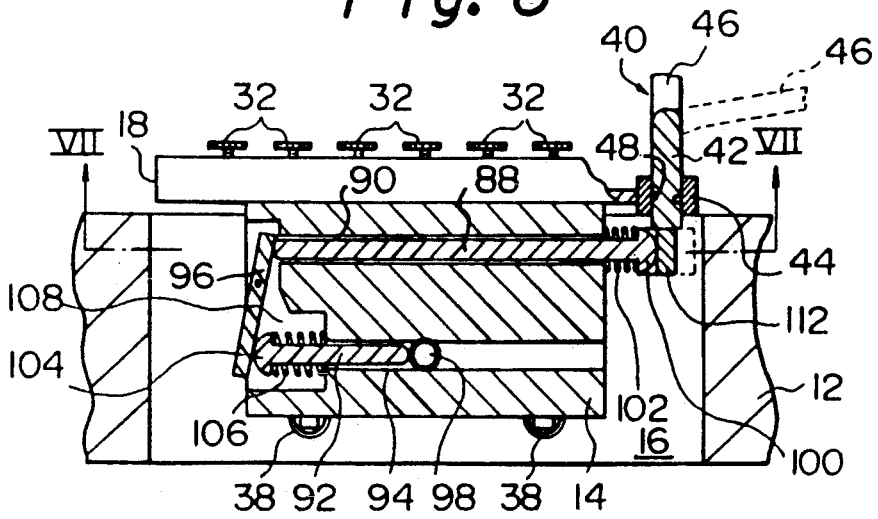
FIG. 6 is a sectional view taken along a line VI—VI of FIG. 7, showing yet another embodiment of a tremolo device according to the present invention.
Figure 7:
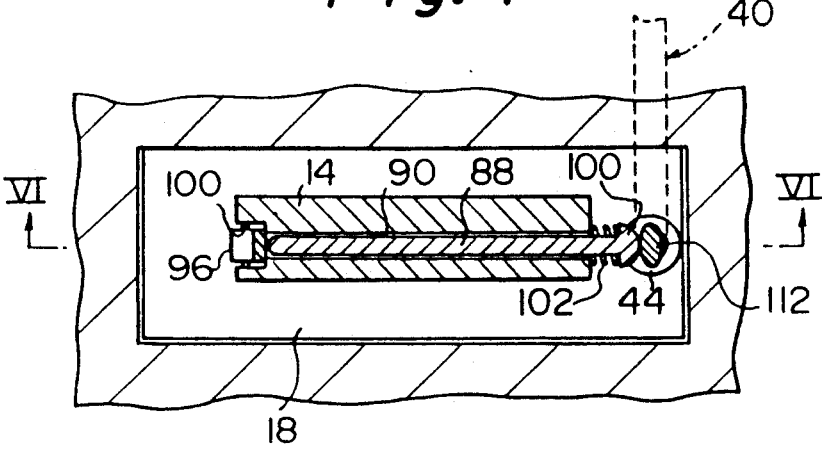
FIG. 7 is a sectional view taken along a line VII—VII of FIG. 6, showing a tremolo handle at an operative position thereof.
Figure 8:
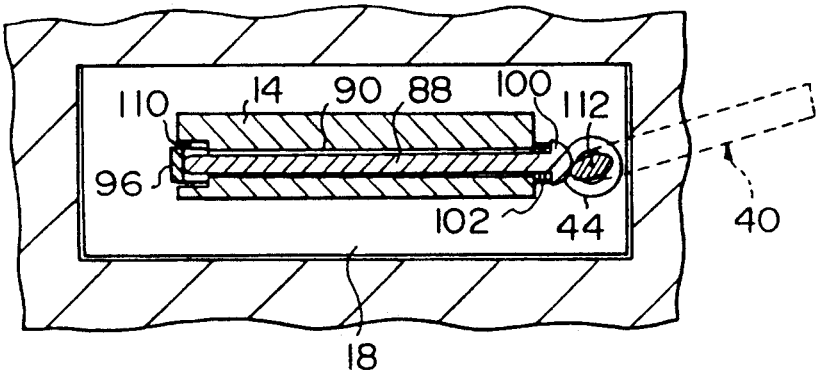
FIG. 8 is a sectional view similar to FIG. 7, but showing the tremolo handle at an inoperative position.

FIGS. 6 to 8 show yet another embodiment of a tremolo device according to the present invention. Also, in these drawings, elements similar to those shown in FIGS. 1 to 3 are indicated by the same reference numerals. Note, FIG. 6 corresponds to a cross sectional view taken along a line VI—VI of FIG. 1. In this embodiment, the lock mechanism comprises a first pin 88 slidably received in an upper guide passage 90 formed in the movable block member 14, a second pin 92 slidably received in a lower guide passage 94, a lever 96 for operatively connecting the first and second pins 88 and 92, and a stop member 98 received in a passage formed at a middle location of the movable block member 14, to intersect the lower guide passage 94. As shown in FIG. 6, the first pin 88 has a head 100 formed at one end thereof and is provided with a compressed coil spring 102 which is constrained between the head 100 and one of the side walls of the movable block member 14. The second pin or lock pin 92 also has a head 104 formed at one end thereof and is provided with a compressed coil spring 106 which is constrained between the head 104 and a wall portion defining a recess 108 formed in the other side wall of the movable block member 14. The lever 96 is disposed in the recess 108 and is rotatably supported by a pivot pin 110. As shown in FIG. 6, the pivot pin 110 is not located at the center of the lever 96, and thus it is provided with short and long arms which are engaged with the other end or free end of the first pin 88 and the head 104 of the second or lock pin 92. The stop member 98 is supported at a wall portion defining the opening 16, in substantially the same manner as in FIG. 4, and can be abutted against the lock pin 92, as mentioned hereinafter in detail.

In the tremolo device shown in FIGS. 6 to 8, the tremolo handle 40 is rotatably supported by the plate-like member 18 in the same manner as in FIG. 1, but the tremolo handle 40 is disposed such that an axis of the root portion 42 thereof and an axis of the first pin 88 intersect each other. The root portion 42 of the tremolo handle 40 has a cam element 112 formed at an lower end thereof and having an oval cross sectional shape, as shown in FIGS. 7 and 8. When the tremolo handle 40 is at the operative position, as shown in FIG. 7, the head 100 of the first pin 88 is resiliently abutted against a side face of the cam element 112, as shown in FIGS. 6 and 7, and thus the second pin or lock pin 92 cannot be abutted against the stop member 98. Namely, the tremolo device can be actuated by the tremolo handle 40. When the tremolo handle 40 is rotated from the operative position as shown in FIG. 7 to the inoperative position as shown in FIG. 8, the first pin 88 is pushed by the cam element 112 in the guide passage 90 against a resilient force of the compressed coil spring 102, whereby the lever 96 is rotated counterclockwise in FIG. 6, and thus the second pin or lock pin 92 is pushed along the guide passage 94 and abutted against the stop member 98, whereby the movable block member 14 is locked at the middle location thereof. The tremolo device shown in FIGS. 6 to 8 is characterized in that a movement of the first pin 88 is magnified by the lever 96, and this magnified movement is transmitted to the lock pin 92. Namely, although a movment of the first pin 88 produced by the cam element 112 is small, the lock pin 92 can be moved by the lever 96 over a distance sufficient to enable it to be abutted against the the stop member 98.

Figure 9:
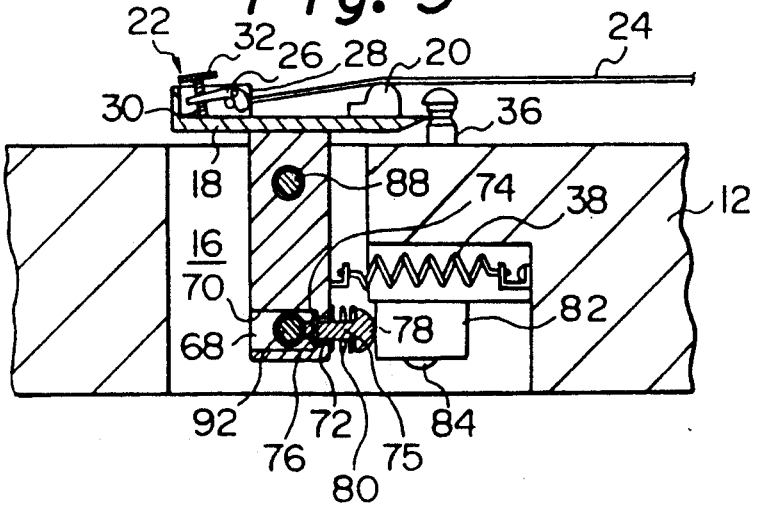
FIG. 9 is a sectional view corresponding to FIG. 1, showing a modification of the embodiment of FIGS. 6 to 8.

FIG. 9 shows a modification of the embodiment shown in FIGS. 6 to 8. In this modified embodiment, the stop member 75 as shown in FIG. 5 is substituted for the stop member 98. In FIG. 9, elements similar to those of FIG. 5 are indicated by the same reference numerals.

Figure 10:
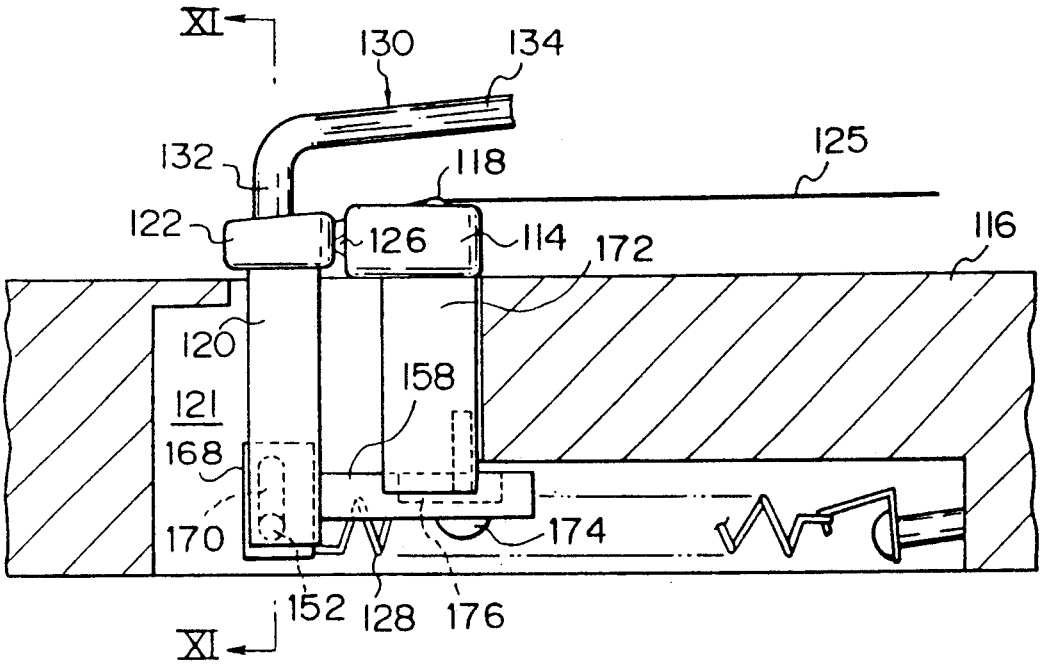
FIG. 10 is a sectional view showing yet another embodiment of a tremolo device according to the present invention.
Figure 11:
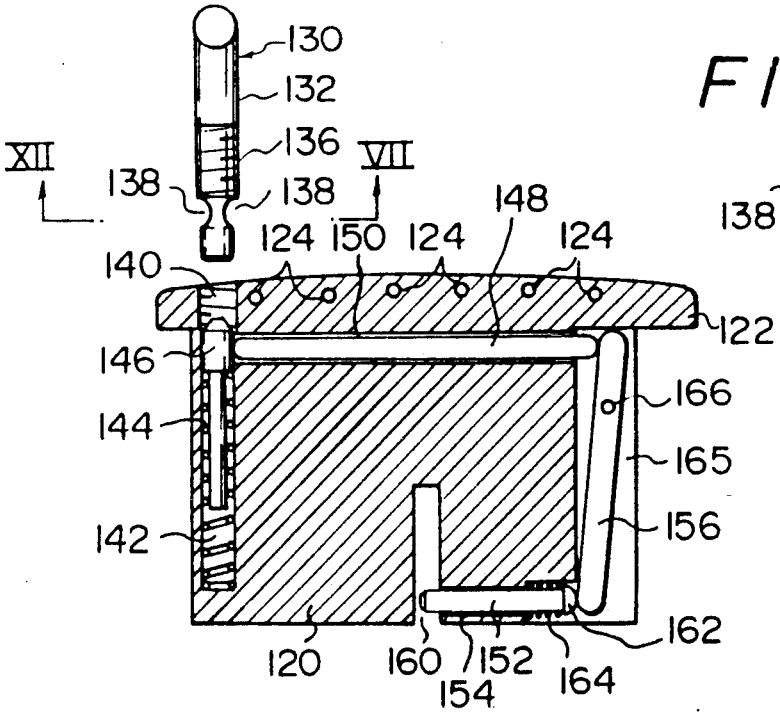
FIG. 11 is a sectional view taken along a line XI—XI of FIG. 10.
Figure 12:
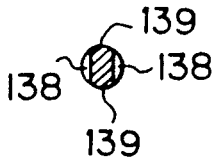
FIG. 12 is a sectional view taken along a line XII—XII of FIG. 11.

FIGS. 10 to 12 show a different type of tremolo device in which the present invention is embodied. In this embodiment, a bridge 114 is immovably mounted on a soundboard or body 116 of an electric guitar and has six grooved small roller elements 118 (only one is shown in FIG. 10) rotatably mounted therein. The tremolo device comprises a movable block member 120 disposed in an opening 121 formed in the guitar body 116 and having a head portion 122 integrally formed at a top thereof. The head portion 122 of the movable block member 120 has six through holes 124 formed therein, as shown in FIG. 11, through which six guitar strings 125 (only one is shown in FIG. 10) are passed and anchored thereto, respectively. In particular, each of the guitar strings 125 has a small annular element (not shown) fixed at one end thereof and having a diameter larger than that of the through holes 124, whereby each guitar string 125 is anchored to the corresponding through holes 124. Note, each guitar string 125 rests on the corresponding grooved small roller elements 118. The bridge 114 has a pair of cone-shaped protrusions 126 (only one is shown in FIG. 10) projected from a rear face thereof and disposed adjacent to the side ends thereof. The head portion 122 of the movable block member 120 has a pair of shallow conical recesses (not shown) formed in a front face thereof and disposed adjacent to the side ends thereof, and the protrusions 126 are abutted against the shallow conical recesses in the head portion 120 so that the movable block member 120 can be swung about a swing axis perpendicular to the guitar strings 125. The movable block member 120 is provided with counter balance tensile spring 128 for providing a tension on all of the guitar strings 125. As shown in FIG. 10, the counter balance tensile springs 128 are disposed in the opening 121 of the guitar body 116 and act on a bottom of the movable block member 120 and a wall portion defining the opening 121, whereby an equilibrium is established between the tension of the counter balance tensile springs 128 and the tension on all of the guitar strings 125, whereby the movable block member 120 is kept at a neutral position.

The tremolo device also comprises a tremolo handle 130 having a root portion 132 and a handle portion 134 radially extended therefrom in such a manner that it is inclined with respect to the front surface of the guitar body 116. The root portion 132 of the tremolo handle 130 has a male threaded 136 formed therearound, as shown in FIG. 11, and a pair of recesses 138 diametrically formed by cutting off a material therefrom and disposed just below the male thread 136, as shown in FIGS. 11 and 12. Note, reference numeral 139 indicates lands formed between the recesses 138, and the lands 139 and the recesses 138 form a cam element as mentioned hereinafter. The head portion 122 has a threaded bore 14 formed therein, for threadedly receiving the male thread 136 of the tremolo handle 130. As shown in FIG. 11, the threaded bore 140 includes a smooth bore 142 extended into the movable block member 120, and a coil spring 144 and a plunger element 146 are received in the smooth bore 142 so that the plunger element 146 is resiliently supported by the coil spring 144. When the male thread 136 of the tremolo handle 130 is threadedly received in the threaded bore 140, the plunger element 146 is depressed by a lower end of the root portion 132 in the smooth bore 142 against a resilient force of the coil spring 144, and accordingly, the tremolo handle 130 can be detachably attached to the head portion 122 of the movable block member 120. Namely, when the tremolo device is not needed, the tremolo handle 130 can be removed from the head portion 122 of the movable block member 120.

The tremolo device shown in FIGS. 10 to 12 further comprises a lock mechanism, for locking the movable block member 120 at the neutral position, which is substantially identical to that of the embodiment shown in FIGS. 6 to 9. The lock mechanism comprises a first pin 148 slidably received in an upper guide passage 150 formed in the movable block member 120, a second pin or lock pin 152 slidably received in a lower guide passage 154, a lever 156 for operatively connecting the first and second pins 148 and 152, and a catch member 158 (FIG. 10) partially received in a slot 160 formed at a middle location of the movable block member 120 to intersect the lower guide passage 154. The second pin or lock pin 152 has a head 162 formed at one end thereof, and is provided with a compressed coil spring 164 which is constrained between the head 162 and a wall portion defining a recess 165 formed in one of the side walls of the movable block member 120. As shown in FIG. 11, the upper guide passage 150 is opened at one end thereof, and one end of the first pin 148 is abutted against the plunger element 146. Also, the other end of the upper guide passage 150 is opened to the recess 165, and the other end of the first pin 148 is projected from the upper guide passage 150 into the recess 165. The lever 156 is disposed in the recess 165 and is rotatably supported by a pivot pin 166. As shown in FIG. 11, the pivot pin 166 is not located at the center of the lever 166 and is provided with short and long arms which are engaged with the other end of the first pin 148 and the head 162 of the second pin or lock pin 152.

As shown in FIG. 10, the catch member 158 has a rectangular plate element 168, integrally formed at one end thereof, which is received in the slot 160 formed in the movable block member at the middle location thereof. The rectangular plate element 168 has an elongated slot 170 into which the second or lock pin 154 can be inserted. The end portion of the catch member 158 is slidably received in a groove formed in a block element 172 fixed to and suspended from the bridge 114, and can be secured to the block element 172 by a set screw 174 screwed in the block element 172 through an elongated slot 176 formed in the end portion of the catch member 158. Note, while the guitar strings are tuned the set screw 174 is loosened, and after the tuning of the guitars strings is completed, the set screw 174 is tightened and the catch member 158 is immovably secured to the block element 172.

When the tremolo handle 130 is removed from the threaded bore 140, i.e., when the plunger element 146 is engaged with the first pin 148, the second pin or lock pin 152 is forcibly moved to the lock position, as shown in FIG. 11, against a resilient force of the compressed coil spring 164. Although the catch element 158 is not shown in FIG. 11, the lock pin 152 is caught by the elongated slot 170 of the plate element 168 of the catch member 158, whereby the movable block member 120 is immovably locked at the middle location thereof.

When the tremolo handle 130 is threadedly engaged with the threaded bore 140, and when the tremolo handle 130 is at an operative position at which the end of first pin 148 is abutted against one of the recesses 138, the lock pin 152 is moved from the lock position to a non-lock position, at which the lock pin is drawn out of the elongated slot 170 of the plate element 168 by the resilient force of the compressed coil spring 164, and thus the tremolo device can be actuated by manually operating the tremolo handle 130. When the tremolo handle is rotated from the operative position to an inoperative position at which the end of first pin 148 is abutted against one of the lands 139, the lock pin 152 is moved from the non-lock position to the lock position.

In the embodiment shown in FIGS. 10 to 12, one of the stop members 54 and 54' shown in FIGS. 4 and 5, respectively, can be substituted for the catch member 158.

Finally, it will be understood by those skilled in the art that the foregoing description is of preferred embodiment of the disclosed device, and that various changes and modifications may be made to the present invention without departing from the spirit and scope thereof.

I claim:

1. A tremolo device for string musical instruments comprising:

a movable block member to which strings of a musical instrument are anchored, said movable block member being swingable about a swing axis perpendicular to the strings, and being provided with a counter balance tensile spring so that an equilibrium is established between a tension imposed by said counter balance tensile spring and a tension imposed on all of said strings, whereby the movable block member is kept at a neutral position;

a tremolo handle rotatably attached to said movable block member so that said tremolo handle is rotatable between an operative position at which said tremolo handle can be manually operated by a player to produce a movement of said movable block member about said swing axis to change the tension imposed on all of said strings and an inoperative position at which said tremolo handle cannot be accidentally touched by the player; and a lock mechanism for locking said movable block member at said neutral position at a middle location thereof in such a manner that said movable block member is prevented from being moved in at least a down direction in which the tension imposed on said strings is increased, said lock mechanism being actuated by rotating said tremolo handle from said operative position to said inoperative position.

2. A tremolo device as set forth in claim 1, wherein said lock mechanism includes: a lock pin slidably received in a guide passage formed in said movable block member, so that said lock pin is movable between a non-lock position and a lock position; a cam element formed as a part of said tremolo handle; a spring means associated with said lock pin for resiliently biasing said lock pin against said cam element, said lock pin being moved from said non-lock position to said lock position by said cam element when said tremolo handle is moved from said operative position to said inoperative position; and a catch member disposed at a middle location with respect to said movable block member, said lock pin being caught by said catch member to lock said movable block member at said neutral position and prevent the movement of said movable block member about said swing axis when said lock pin is at said lock position.

3. A tremolo device as set forth in claim 1, wherein said lock mechanism includes: a lock pin slidably received in a guide passage formed in said movable block member so that said lock pin is movable between a non-lock position and a lock position; a cam element formed as a part of said tremolo handle; a spring means associated with said lock pin for resiliently biasing said lock pin against said cam element, said lock pin being moved from said non-lock position to said lock position by said cam element when said tremolo handle is moved from said operative position to said inoperative position; and a stop member disposed at a middle location with respect to said movable block member, said lock pin being abutted against said stop member to prevent a movement of said movable block member in said down direction when said lock pin is at said lock position.

4. A tremolo device as set forth in claim 1, wherein said lock mechanism includes: a first pin slidably received in a first guide passage formed in said movable block member; a second pin slidably received in a second guide passage formed in said movable block member so that said second pin is movable between a non-lock position and a lock position; a lever for operatively connecting said first and second pins so that a movement of said first pin is magnified and transmitted to said second pin, said second pin being movable between a non-lock position and a lock position; a cam element formed as a part of said tremolo handle; a spring means associated with at least one of said first and second pins, for resiliently biasing said first pin against said cam element, said second pin being moved from said non-lock position to said lock position by said cam element when said tremolo handle is moved from said operative position to said inoperative position; and a catch member disposed at a middle location with respect to said movable block member, said second pin being caught by said catch member to lock said movable block member at said neutral position and prevent a movement of said movable block member about said swing axis when said second pin is at said lock position.

5. A tremolo device as set forth in claim 4, wherein said cam element is formed by cutting off a material from said tremolo handle.

6. A tremolo device as set forth in claim 4, wherein said tremolo handle is detachably attached to said movable block member, said lock mechanism further including a plunger element movable between a first position at which said plunger element is engaged with said first pin to move said second pin from said non-lock position to said lock position, and a second position at which said plunger element is disengaged from said first pin, and a spring for resiliently biasing said plunger element from said second position to said first position, said plunger element being forcibly moved from said first position to said second position when said tremolo handle is attached to said movable block member.

7. A tremolo device as set forth in claim 1, wherein said lock mechanism includes: a first pin slidably received in a first guide passage formed in said movable block member; a second pin slidably received in a second guide passage formed in said movable block member so that said second pin is movable between a non-lock position and a lock position; a lever for operatively connecting said first and second pins so that a movement of said first pin is magnified and transmitted to said second pin, said second pin being movable between a non-lock position and a lock position; a cam element formed as a part of said tremolo handle; a spring means associated with at least one of said first and second pins, for resiliently biasing said first pin against said cam element, said second pin being moved from said non-lock position to said lock position by said cam element when said tremolo handle is moved from said operative position to said inoperative position; and a stop member disposed at a middle location with respect to said movable block member, said second pin being abutted against said stop member to lock said movable block member at said neutral position and prevent a movement of said movable block member about in said down direction when said second pin is at said lock position.

8. A tremolo device as set forth in claim 7, wherein said cam element is formed by cutting off a material from said tremolo handle.

9. A tremolo device as set forth in claim 7, wherein said tremolo handle is detachably attached to said movable block member, said lock mechanism further including a plunger element movable between a first position at which said plunger element is engaged with said first pin to move said second pin from said non-lock position to said lock position and a second position at which said plunger element is disengaged from said first pin, and a spring for resiliently biasing said plunger element from said second position to said first position, said plunger element being forcibly moved from said first position to said second position when said tremolo handle is attached to said movable block member.

* * * * *